US005274930A

United States Patent [19]

Ensign et al.

[11] Patent Number: 5,274,930

[45] Date of Patent: Jan. 4, 1994

[54] LIMITING ORIFICE DRYING OF CELLULOSIC FIBROUS STRUCTURES, APPARATUS THEREFOR, AND CELLULOSIC FIBROUS STRUCTURES PRODUCED THEREBY

[75] Inventors: Donald E. Ensign; Wilbur R. Knight, both of Cincinnati; Paul D. Trokhan, Hamilton, all of Ohio

[73] Assignee: The Procter & Gamble Company, Cincinnati, Ohio

[21] Appl. No.: 906,962

[22] Filed: Jun. 30, 1992

[51] Int. Cl.[5] ..... F26B 3/00

[52] U.S. Cl. ..... 34/23; 34/243 R

[58] Field of Search ..... 34/155, 156, 160, 23, 34/123, 116, 243 R; 162/358, 361

[56] References Cited

U.S. PATENT DOCUMENTS

| | | | |
|---|---|---|---|
| Re. 28,459 | 7/1975 | Cole et al. | 34/6 |
| 1,666,472 | 4/1928 | Seybold et al. . | |
| 1,808,493 | 6/1931 | Burden . | |
| 2,069,119 | 1/1937 | Standley et al. | 92/53 |
| 3,432,936 | 3/1969 | Cole et al. | 34/6 |
| 4,172,910 | 10/1979 | Rotar | 427/243 |
| 4,251,928 | 2/1981 | Rotar et al. | 34/116 |
| 4,329,201 | 5/1982 | Bolton | 162/198 |
| 4,361,466 | 11/1982 | Wong et al. | 162/207 |
| 4,528,239 | 7/1985 | Trokhan | 428/247 |
| 4,529,480 | 7/1985 | Trokhan | 162/109 |
| 4,556,450 | 12/1985 | Chuang et al. | 162/204 |
| 4,583,302 | 4/1986 | Smith | 34/116 |
| 4,888,096 | 12/1989 | Cowan et al. | 162/358 |
| 4,921,750 | 5/1990 | Todd | 428/225 |
| 4,942,675 | 7/1990 | Sundovist | 34/23 |
| 4,953,297 | 9/1990 | Eskelinen et al. | 34/23 |
| 4,973,385 | 11/1990 | Jean et al. | 162/368 |
| 5,013,330 | 5/1991 | Durkin et al. | 51/297 |

*Primary Examiner*—Henry A. Bennet

*Attorney, Agent, or Firm*—Larry L. Huston; Fredrick H. Braun

[57] ABSTRACT

A method and apparatus for drying of a cellulosic fibrous structure having constant basis weight and/or density or multiple regions varying in basis weight and/or density. Such a cellulosic fibrous structure may have a nonuniform moisture distribution prior to drying by the disclosed method and apparatus. An equally or more uniform moisture distribution is achieved by providing a micropore medium in the air flow path which has a greater flow resistance than the interstices between the fibers in the cellulosic fibrous structure web. The micropore medium is the limiting orifice in the air flow used in the drying process. The micropore medium may be executed in a laminate of plural laminae, each of successively increasing or decreasing pore size. This arrangement provides the advantage that minimal sagging or deformation of each lamina into the next coarser lamina occurs and lateral air flow between the micropore medium and the cellulosic fibrous structure is reduced. The micropore medium may be disposed either upstream or downstream in the air flow path of the cellulosic fibrous structure to be through-air dried.

13 Claims, 4 Drawing Sheets

LIMITING ORIFICE DRYING OF CELLULOSIC FIBROUS STRUCTURES, APPARATUS THEREFOR, AND CELLULOSIC FIBROUS STRUCTURES PRODUCED THEREBY

FIELD OF THE INVENTION

The present invention relates to cellulosic fibrous structures, and particularly to cellulosic fibrous structures having an embryonic web which is through-air dried.

BACKGROUND OF THE INVENTION

Cellulosic fibrous structures have become a staple of everyday life. Cellulosic fibrous structures are found in facial tissues, toilet tissues and paper toweling.

One recent advance in the art of cellulosic fibrous structures is to provide multiple regions in the cellulosic fibrous structure. A cellulosic fibrous structure is considered to have multiple regions when one region of the cellulosic fibrous structure differs in either basis weight, density, or both, from an adjacent region of the cellulosic fibrous structure.

Multiple regions in a cellulosic fibrous structure provide the advantage of economization of the fibers used in manufacture. Furthermore, the regions can be tailored to different functions desired by the consumer of the cellulosic fibrous structure. Functions such as providing absorbency, tensile strength and even opacity may be provided by the different regions.

In the manufacture of cellulosic fibrous structures, a wet embryonic web of cellulosic fibers dispersed in a liquid carrier is deposited onto a forming wire. The wet embryonic web may be dried by any one of or combinations of several known means, each of which drying means will affect the properties of the resulting cellulosic fibrous structure. For example, the drying means and process can influence the softness, caliper, tensile strength, and absorbency of the resulting cellulosic fibrous structure. Also the means and process used to dry the cellulosic fibrous structure affects the rate at which it can be manufactured, without being rate limited by such drying means and process.

An example of one drying means is felt belts. Felt drying belts have long been used to dewater an embryonic cellulosic fibrous structure through capillary flow of the liquid carrier into a permeable felt medium held in contact with the embryonic web. However, dewatering a cellulosic fibrous structure into and by using a felt belt results in overall uniform compression and compaction of the embryonic cellulosic fibrous structure web to be dried.

Felt belt drying may be assisted by a vacuum, or may be assisted by opposed press rolls. The press rolls maximize the mechanical compression of the felt against the cellulosic fibrous structure. Examples of felt belt drying are illustrated in U.S. Pat. No. 4,329,201 issued May 11, 1982 to Bolton and U.S. Pat. No. 4,888,096 issued Dec. 19, 1989 to Cowan et al.

Generally, however, a felt belt is unsuitable for the production and drying of a cellulosic fibrous structure having multiple regions. Other means of drying a cellulosic fibrous structure having multiple regions are preferred, due to the different amounts of water contained in different regions, in addition to avoiding overall compaction of the cellulosic fibrous structure as noted above.

For example, drying cellulosic fibrous structures through vacuum dewatering, without the aid of felt belts is known in the art. Vacuum dewatering of the cellulosic fibrous structure mechanically removes moisture from the cellulosic fibrous structure while the moisture is in the liquid form. Furthermore, the vacuum deflects discrete regions of the cellulosic fibrous structure into the deflection conduits of the drying belts and strongly contributes to having different amounts of moisture in the various regions of the cellulosic fibrous structure. Similarly, drying a cellulosic fibrous structure through a vacuum assisted capillary flow, using a porous cylinder having preferential pore sizes is known in the art as well. Examples of such vacuum driven drying techniques are illustrated in commonly assigned U.S. Pat. No. 4,556,450 issued Dec. 3, 1985 to Chuang et al. and U.S. Pat. No. 4,973,385 issued Nov. 27, 1990 to Jean et al.

In yet another drying process, considerable success has been achieved drying the embryonic web of a cellulosic fibrous structures by through-air drying. In a typical through-air drying process, a foraminous air permeable belt supports the embryonic web to be dried. Hot air flow passes through the cellulosic fibrous structure, then through the permeable belt or vice versa. Regions coincident with and deflected into the foramina in the air permeable belt are preferentially dried and the caliper of the resulting cellulosic fibrous structure, increased. Regions coincident the knuckles in the air permeable belt are dried to a lesser extent. The air flow principally dries the embryonic web by evaporation.

Several improvements to the air permeable belts used in through-air drying have been accomplished in the art. For example, the air permeable belt may be made with a high open area (at least forty percent). Or, the belt may be made to have reduced air permeability. Reduced air permeability may be accomplished by applying a resinous mixture to obturate the interstices between woven yarns in the belt. The drying belt may be impregnated with metallic particles to increase its thermal conductivity and reduce its emissivity or, alternatively, the drying belt may be constructed from a photosensitive resin comprising a continuous network. The drying belt may be specially adapted for high temperature air flows, of up to about 815 degrees C. (1500 degrees F). Examples of such through-air drying technology are found in U.S. Pat. No. Re. 28459 reissued Jul. 1, 1975 to Cole et al., U.S. Pat. No. 4,172,910 issued Oct. 30, 1979 to Rotar, U.S. Pat. No. 4,251,928 issued Feb. 24, 1981 to Rotar et al., commonly assigned U.S. Pat. No. 4,528,239 issued Jul. 9, 1985 to Trokhan, and U.S. Pat. No. 4,921,750 issued May 1, 1990 to Todd.

Additionally, several attempts have been made in the art to regulate the drying profile of the cellulosic fibrous structure while it is still an embryonic web to be dried. Such attempts may use either the drying belt, or an infrared dryer in combination with a Yankee hood. Examples of profiled drying are illustrated in U.S. Pat. No. 4,583,302 issued Apr. 22, 1986 to Smith and U.S. Pat. No. 4,942,675 issued Jul. 24, 1990 to Sundovist.

The foregoing art, particularly that addressed to through-air drying, does not address the problems encountered when drying a multi-region cellulosic fibrous structure. For example, a first region of the cellulosic fibrous structure, having a lesser absolute moisture, density or basis weight than a second region, will typically have relatively greater air flow therethrough than the second region. This relatively greater air flow occurs because the first region of lesser absolute moisture, density or basis weight presents a proportionately lesser flow resistance to the air passing through such region.

This problem is exacerbated when the multi-region cellulosic fibrous structure to be dried is transferred to a Yankee drying drum. On a Yankee drying drum, isolated discrete regions of the cellulosic fibrous structure are in intimate contact with the circumference of a heated cylinder and hot air from a hood is introduced to the surface of the cellulosic fibrous structure opposite the heated cylinder. However, typically the most intimate contact with the Yankee drying drum occurs at the high density or high basis weight regions, which are not as dry as the low density or low basis weight regions. Preferential drying of the low density regions occurs by convective transfer of the heat from the air flow in the Yankee drying drum hood. Accordingly, the production rate of the cellulosic fibrous structure must be slowed, to compensate for the greater moisture in the high density or high basis weight region. To allow complete drying of the high density and high basis weight regions of the cellulosic fibrous structure to occur and to prevent scorching or burning of the already dried low density or low basis weight regions by the air from the hood, the Yankee hood air temperature must be decreased and the residence time of the cellulosic fibrous structure in the Yankee hood must be increased, slowing the production rate.

Another drawback to the approaches in the prior art (except those that use mechanical compression, such as felt belts) is that each relies upon supporting the cellulosic fibrous structure to be dried. Air flow is directed towards the cellulosic fibrous structure and is transferred through the supporting belt, or, alternatively, flows through the drying belt to the cellulosic fibrous structure. Differences in flow resistance through the belt or through the cellulosic fibrous structure, amplifies differences in moisture distribution within the cellulosic fibrous structure, and/or creates differences in moisture distribution where none previously existed. However, no attempt has been made in the art to tailor the air flow to the differences in various regions of the cellulosic fibrous structure.

Particularly, no attempt has been made in the art to refine or direct the air flow away from the low density or low basis weight regions which need such air flow the least, to the high density or high basis weight regions, which have relatively more moisture. Likewise, no attempt has been made to promote uniform drying of each region of the cellulosic fibrous structure.

Accordingly, it is an object of this invention to provide an apparatus and process to direct air flow in a limiting-orifice-through-air-drying process substantially equally to and through the low density and low basis weight regions and the high density and high basis weight regions. This apparatus and process are intended to be used with the manufacture of paper utilizing limiting-orifice-through-air drying, conventional press felts, infrared drying, etc. and combinations thereof. It is also an object of this invention to provide an apparatus and process for reducing occurrences of being rate limited in the production of a cellulosic fibrous structure by the through-air drying or Yankee drum drying steps of the manufacturing process. It is finally an object of this invention to produce a multi-region cellulosic fibrous structure using such process and apparatus.

SUMMARY OF THE INVENTION

The invention comprises a micropore medium for use with a limiting-orifice-through-air-drying apparatus. The micropore medium is used in combination with an embryonic web of cellulosic fibers having a moisture distribution therein, and provides the limiting orifice for air flow through the embryonic web.

In one embodiment, the invention comprises an apparatus having a through-air-drying belt on one side of the embryonic web for transporting it, and a micropore medium disposed on the opposite side of the embryonic web in an attempt to provide substantially uniform air flow to or through the embryonic web. The apparatus also has a means for causing air flow through the embryonic web, wherein the micropore medium is the limiting orifice for the air flow through the embryonic web. The moisture distribution is equally or more uniform after drying by this apparatus.

In another embodiment, the invention comprises a process for limiting-orifice-through-air drying a cellulosic fibrous structure. The process comprises the steps of providing an embryonic web to be dried, a means for causing air flow through the embryonic web, a drying belt to support the embryonic web from one side, and a micropore medium opposite the drying belt. Air flow through the embryonic web is caused, wherein the micropore medium is the limiting orifice in the air flow. The moisture distribution in the embryonic web is equally or more uniform after drying by this process.

BRIEF DESCRIPTION OF THE DRAWINGS

While the Specification concludes with claims particularly pointing out and distinctly claiming the present invention, it is believed the same will be better understood from the following description in accordance with the drawings, in which like components are given the same reference numeral and:

DETAILED DESCRIPTION OF THE INVENTION

Figure 1:
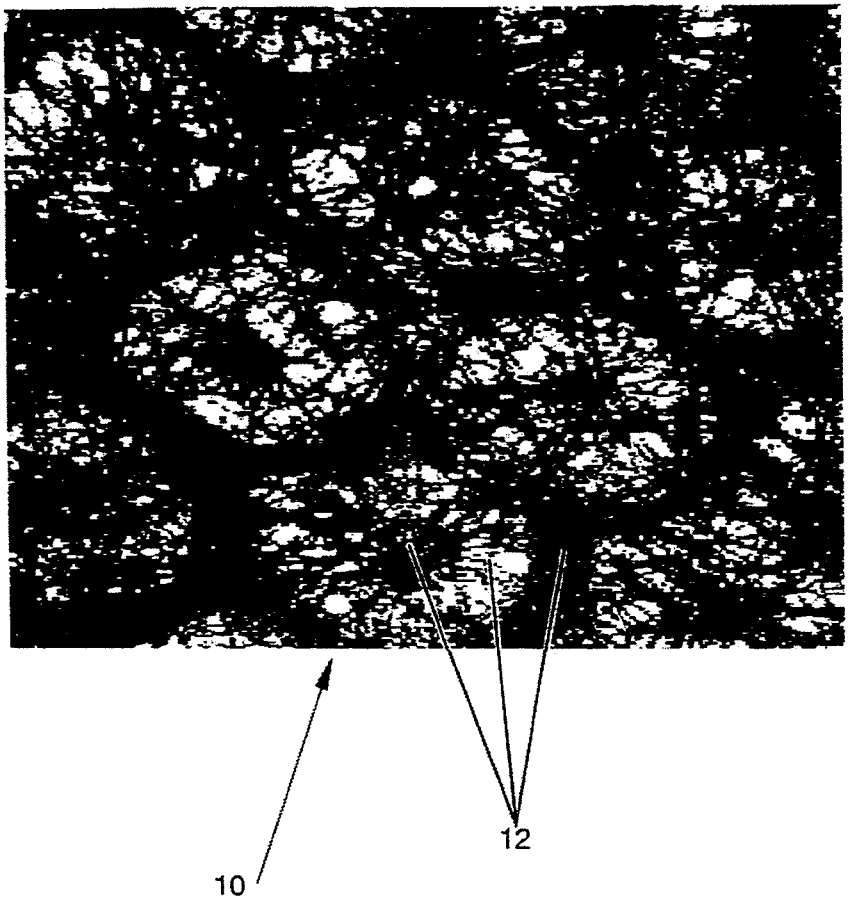
FIG. 1 is a fragmentary top plan view of a multiple region cellulosic fibrous structure made according to the present invention.

The present invention may be used to manufacture a cellulosic fibrous structure 10, as illustrated in FIG. 1. The cellulosic fibrous structure 10 may be composed of a single region 12, or preferably comprises multiple regions 12, as described above and illustrated by the figure. The cellulosic fibrous structure 10 is suitable for use as a consumer product such as toilet tissue, facial tissue or paper toweling.

The fibers of the cellulosic fibrous structure 10 are components which have one very large dimension (along the longitudinal axis of the fiber) compared to the other two relatively small dimensions (mutually perpendicular, and being both radial and perpendicular to the longitudinal axis of the fiber), so that linearity is approximated. While microscopic examination of the fibers may reveal two other dimensions which are small, compared to the principal dimension of the fibers, such other two small dimensions need not be substantially equivalent nor constant throughout the axial length of the fiber. It is only important that the fiber be able to bend about its axis, be able to bond to other fibers, and to be able to be distributed by a liquid carrier and subsequently dried.

The fibers comprising the cellulosic fibrous structure 10 may be synthetic, such as polyolefin or polyester; and are preferably cellulosic, such as cotton linters, rayon, or bagasse; and more preferably are wood pulp, such as soft woods (gymnosperms or coniferous) or hard woods (angiosperms or deciduous). A cellulosic mixture of wood pulp fibers comprising soft wood fibers having a length of about 2.0 to about 4.5 millimeters and a diameter of about 25 to about 50 micrometers, and hardwood fibers having a length of less than about 1 millimeter and a diameter of about 12 to about 25 micrometers has been found to work well for the papers described herein.

The fibers may be produced by any pulping process including chemical processes, such as sulfite, sulfate and soda processes; and mechanical processes such as stone groundwood. Alternatively, the fibers may be produced by combinations of chemical and mechanical processes or may be recycled. The type, combination, and processing of the fibers used for the cellulosic fibrous structures 10 described herein are not critical to the present invention.

Figure 2:
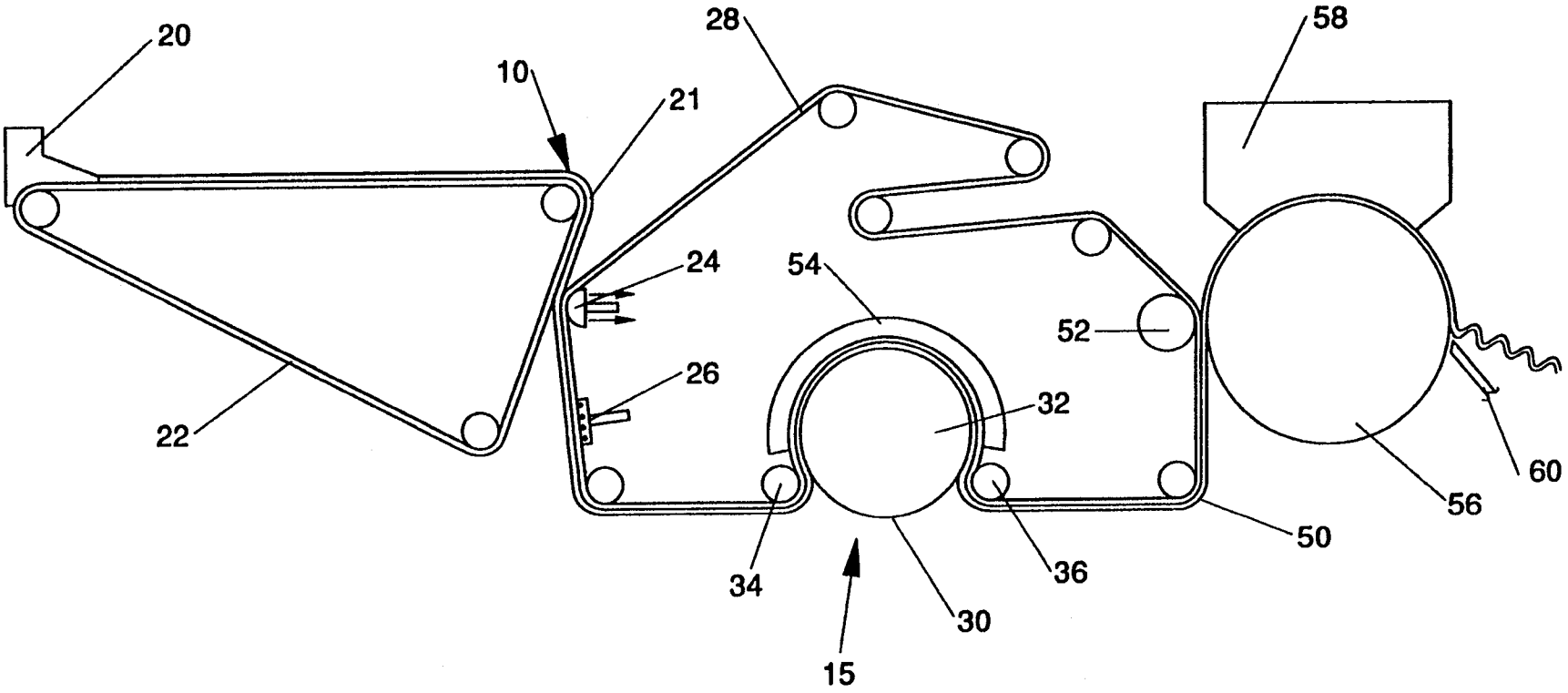
FIG. 2 is a schematic side elevational view of a papermaking machine according to the present invention.

Referring to FIG. 2 and utilizing an apparatus 15 for papermaking, the first step in practicing the process according to the present invention is to provide an aqueous dispersion of cellulosic fibers. The aqueous dispersion of cellulosic fibers is disposed in a headbox 20. A single headbox 20, as shown, may be utilized, however it is understood alternative arrangements utilize multiple headboxes 20 in the papermaking process. The headbox 20 or headboxes 20 and equipment for preparing the aqueous dispersion of papermaking fibers are adequately disclosed in commonly assigned U.S. Pat. No. 3,994,771 issued Nov. 30, 1976 to Morgan et al. and in commonly assigned U.S. Pat. No. 4,529,480 issued Jul. 16, 1985 to Trokhan, which patents are incorporated herein by reference for the purpose of showing equipment useful in the preparation and dispersion of papermaking fibers.

The aqueous dispersion of papermaking fibers is supplied in a liquid carrier from the headbox 20 to a forming belt such as a Fourdrinier wire 22. The Fourdrinier wire 22 is supported by a breast roll and a plurality of return rolls. Additionally, commonly associated with a Fourdrinier wire 22 are forming boards, vacuum boxes, tension rolls, cleaning showers, etc., which are well known in the art and not further discussed or illustrated herein.

The aqueous dispersion of papermaking fibers is used to form an embryonic web 21 on the Fourdrinier wire 22 or other forming section wire. As used herein an "embryonic web" refers to a deposit of fibers subjected to rearrangement on a Fourdrinier wire 22 or other forming belt during the course of the papermaking process prior to the drying steps discussed below. Conventional vacuum boxes 26, etc. may be utilized to continue the removal of water from the aqueous embryonic web 21.

The embryonic web 21 is transferred to a second papermaking belt, particularly a drying belt 28. Any air pervious through-air drying belt 28 may be utilized. A particularly preferred drying belt 28 utilizes a continuous photosensitive resinous network. A particularly preferred drying belt 28 may be made in accordance with commonly assigned U.S. Pat. No. 4,528,239 issued Jul. 9, 1985 to Trokhan, which patent is incorporated herein by reference for the purpose of showing a drying belt 28 suitable for use with the present invention. If desired, the drying belt 28 may be provided with a textured backside. A drying belt 28 having such a textured backside may be preferentially made in accordance with commonly assigned U.S. Pat. No. 5,059,283 issued Oct. 22, 1991, to Hood et al. and 5,073,235 issued Dec. 17, 1991, to Trokhan.

The embryonic web 21 may be transferred from the forming section wire 22 to the drying belt 28 by applying a pressure differential to the embryonic web 21. Particularly, the embryonic web 21 may be transferred by a transfer head 24 which separates the embryonic web 21 from the forming section wire 22, deflects the embryonic web 21 into the foramina of the drying belt 28 and simultaneously dewaters the embryonic web 21. The embryonic web 21 may be held in place on the drying belt 28 by a vacuum box 26. It is understood however other means for applying a fluid pressure differential to the embryonic web 21 may be utilized, so long as the embryonic web 21 is transferred from the forming wire to the drying belt 28.

The vacuum box 26 provides for additional deflection of the regions 12 of the cellulosic fibrous structure 10 into the foramina of the drying belt 28. The deflection causes the regions 12 so deflected to have a different density and/or basis weight than the regions 12 not so deflected. The vacuum box 26 causes mechanical dewatering of the embryonic web 21. Alternatively or in addition to the vacuum box 26, a roll made in accordance with commonly assigned U.S. Pat. No. 4,556,450 issued Dec. 3, 1985 to Chuang et al. may be utilized as well, which patent is incorporated herein by reference for the purpose of showing an apparatus 15 suitable for mechanically dewatering an embryonic web 21.

The drying belt 28 may be cleansed with water showers (not shown) to remove cellulosic fibrous structure 10 fibers, adhesive, and the like which remain attached to the drying belt 28 after the embryonic web 21 is removed therefrom. The drying belt may also have an emulsion applied to act as a release agent and extend the useful life of the belt by reducing oxygen degradation. Preferred emulsion and distribution methods are disclosed in the aforementioned commonly assigned U.S. Pat. No. 5,073,235 issued Dec. 17, 1991, to Trokhan.

The embryonic web 21 has moisture from the manufacturing process distributed therein. The moisture distribution may be substantially uniform, but is more likely nonuniform, corresponding to a repeating pattern in the embryonic web 21. The repeating pattern in the embryonic web 21 is due to a like pattern of regions of differing basis weights and/or densities. This moisture distribution may be qualitatively determined on a scale corresponding to the repeating pattern by image analysis of soft X-rays or other means well known in the art.

The drying belt 28 transports the embryonic web 21 to the apparatus 15 for directing air flow in a through-air drying process equally to and through the low density and low basis weight regions 12 and the high density and high basis weight regions 12 according to the present invention. This apparatus 15 according to the present invention comprises a micropore drying medium, a means for supporting this medium and an embryonic cellulosic fibrous structure 10 to be dried, and a means for causing air flow through the micropore drying medium 30 and embryonic cellulosic fibrous structure 10.

Particularly, the drying belt 28 transports the cellulosic fibrous structure 10 to an axially rotatable porous cylinder 32. The circumference of the porous cylinder 32 is peripherally covered with a micropore medium 30 according to the present invention. The porous cylinder 32 may be internally provided with a subatmospheric pressure for the embodiment described herein, although it will be later described that the porous cylinder 32 may be provided with a positive pressure relative to the atmosphere. The positive pressure must be sufficient to provide flow through the cellulosic fibrous structure 10, and preferably exceeds the breakthrough pressure of the micropore medium 30 in case any liquid water is present in the pores thereof. For the embodiments described herein a subatmospheric pressure of about 2.5 to about 30.5 centimeters of Mercury (1 to 12 inches of Mercury), and preferably about 17.8 to about 25.4 centimeters of Mercury (7 to 10 inches of Mercury) has been found to work well.

Figure 3A:
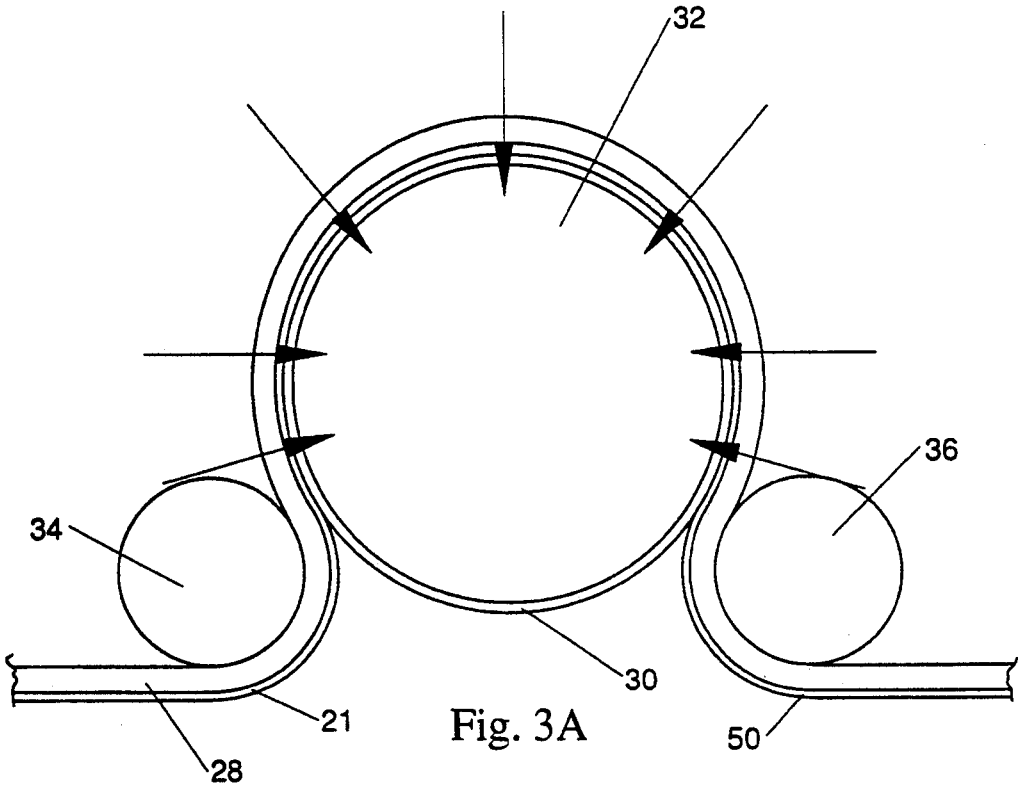
FIG. 3A is a schematic side elevational view of a micropore medium according to the present invention embodied on a previous cylinder which has a subatmospheric internal pressure.

Referring to FIG. 3A, the drying belt 28 wraps the porous cylinder 32 from an inlet roll 34 to a takeoff roll 36 and subtends an arc defining a circular segment. A subatmospheric pressure is applied throughout this circular segment to remove water from the embryonic web 21 and to the inside of the porous cylinder 32. The web then exits the porous cylinder 32 at the take off roll 36, being substantially dried, preferably to a consistency of at least about 30 percent and more preferably at least about 50 percent.

During the period the embryonic web 21 is in contact with the porous cylinder 32, the aforementioned drying belt 28 is on the outside of the circular segment, the porous cylinder 32, covered by the micropore medium 30 is on the inside of the circular segment, and the embryonic web 21 is between the outer drying belt 28 and the inner micropore medium 30. Due to the subatmospheric pressure internal to the porous cylinder 32, air flow is drawn through the laminate formed by the drying belt 28, the embryonic web 21, the micropore medium 30, and the porous cylinder 32.

Referring again to FIG. 2, the apparatus 15 used to manufacture the cellulosic fibrous structure 10 is further provided with a hood 54, to supply hot air to dry the embryonic web 21. Particularly, the hood 54 provides dry, hot air for the air flow through the embryonic web 21. It is important that the air flow not add water to the embryonic web 21, but instead be capable of removing water through evaporation and mechanical entrainment. It is noted however, that saturated air may be suitable, if only mechanical dewatering is intended. Preferably the hood 54 is able to provide air flow at a temperature from ambient to about 290 degrees C. (500 degrees F.) and preferably about 93 to about 150 degrees C. (200 to 300 degrees F.) for the air flow through the embryonic web 21.

One advantage to using relatively lower temperature air is the reduced proclivity of the drying belt 28 and cellulosic fibrous structure 10 to prematurely fail, or to scorch, burn, or develop malodors, respectively, during the manufacturing process when using lower temperature air flows, as well as potential energy savings. Such a hood 54 may be constructed and supplied in accordance with the means and skills ordinarily known in the art and will not be further herein described.

When the embryonic web 21 is introduced to the micropore medium 30 and porous cylinder 32, the embryonic web 21 may have a consistency of about 5 to about 50 percent. Such a web may be dried to a consistency of about 25 to about 100 percent, depending upon the incoming moisture, fiber composition, micropore medium 30 geometry, the basis weight of the embryonic web 21, the residence time of the embryonic web 21 on the micropore medium 30, and the air flow rate and moisture content and the temperature through the embryonic web 21.

Generally, as the basis weight of the embryonic web 21 increases, greater residence time of the embryonic web 21 on the micropore medium 30 is necessary. For example, the apparatus 15 should provide the embryonic web 21 a residence time of at least about 250 milliseconds on the micropore medium 30 for an embryonic web 21 having a basis weight of about 0.02 kilograms per square meter (12 pounds per 3,000 square feet) and a consistency of 30 to 50 percent.

As used herein a "micropore medium" refers to any component which allows air flow therethrough and can be used to direct, tailor, refine or reduce air flow to another component. The other component may either be upstream or downstream of the micropore medium 30. The micropore medium 30 may be generally planar, as shown, or embodied in any desired configuration. Preferably, the pores in the micropore medium 30 are of lesser hydraulic radius than the interstices in the cellulosic fibrous structure 10 and are well distributed to provide substantially uniform air flow to all of the cellulosic fibrous structure 10 within the range of such air flow. Alternatively, air flow through the micropore medium 30 may be influenced by providing a high resistance flow path (several turns, flow restrictions, small ducts, etc.) through the micropore medium 30, providing the limiting orifices are still uniformly distributed.

Figure 4:
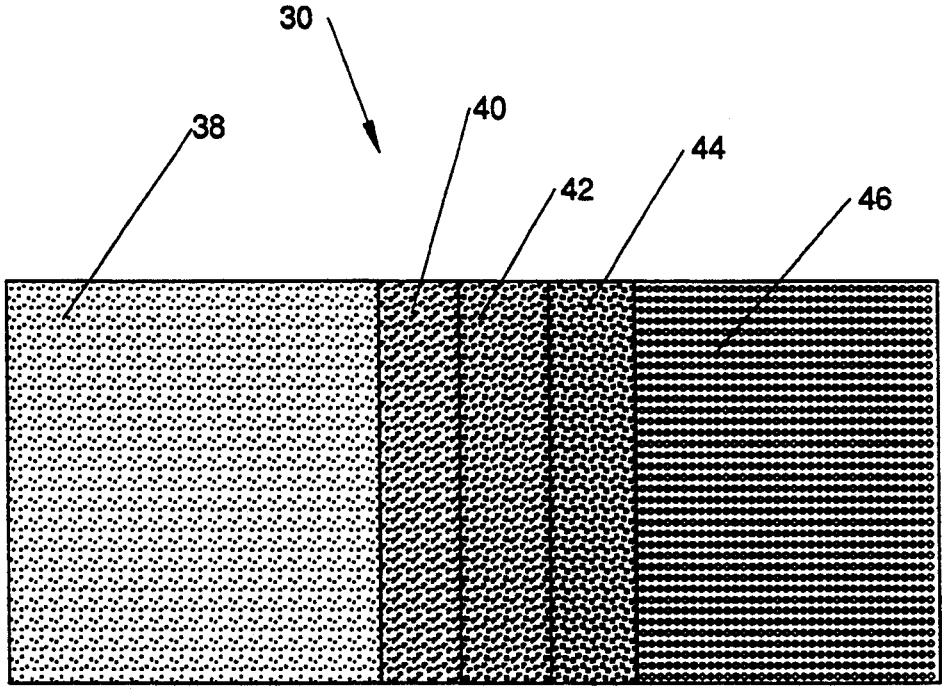
FIG. 4 is a fragmentary top plan view of a micropore medium according to the present invention showing the various laminae.

Referring to FIG. 4, the micropore medium 30 creates a limiting orifice for the air flow through the drying belt 28, and particularly through the embryonic web 21. As used herein, a "limiting orifice" refers to the component which provides the greatest individual component of flow resistance to the air flow. It is important that the combination of the flow resistances through the drying belt 28, embryonic web 21, micropore medium 30, and cylinder, and the pressure differential across the same, be such that the micropore medium 30 is the limiting orifice in such air flow. By having the limiting orifice to the air flow at the micropore medium 30, uniform air flow to substantially all of the various and different regions 12 of the cellulosic fibrous structure 10 is believed to be provided, although the present invention is not limited by any such theory.

As illustrated by FIG. 3A, the same air flow that dries the embryonic web 21 finally passes through the micropore medium 30 to the porous cylinder 32 and its interior. Therefore, the flow path through the micropore medium 30 must be sized and configured to provide a limiting orifice in the path of such air flow. As used herein, the "flow path" refers to an area or combination of areas through which air flow is directed as part of the drying process.

Figure 3B:
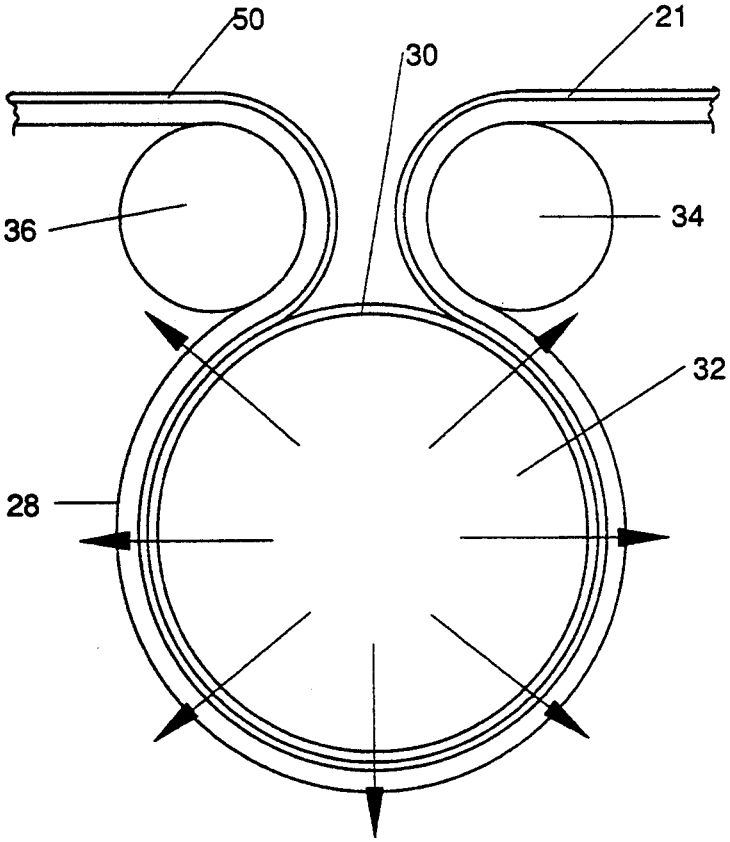
FIG. 3B is a schematic side elevational view of a micropore medium roll according to the present invention embodied on a pervious cylinder which has a positive internal pressure.

The micropore medium 30 and the cellulosic fibrous structure 10 should be in contacting relationship, particularly for the flow arrangement of FIG. 3B, to prevent a plenum from being created therebetween and the air flow to or through the cellulosic fibrous structure 10 being limited by the flow resistance of the individual regions 12 thereof. The plenum allows air flow lateral to the embryonic web 21 to occur and prevents the desirable uniform air flow to or through the embryonic web 21. As used herein, air flow is considered to be "lateral" when such air flow has a principal direction of travel which is parallel to the plane of the micropore medium 30 when such air flow is in the vicinity of the embryonic web 21.

After the embryonic web 21 is dried by the micropore medium 30 and the associated process, the moisture distribution therein is equally uniform, or more uniform than prior to drying. In any event, differences in moisture distribution are not created and/or amplified, as occurs in through-air-drying processes according to the prior art. This moisture distribution is again considered on a scale corresponding to the repeating pattern in the embryonic web 21. Qualitatively the relative uniformity of the moisture distribution may be determined by image analysis of soft X-rays or by any other means which provides a relative measurement suitable for the scale.

Prophetically, for the embodiment of FIG. 3A, the cellulosic fibrous structure 10 may be spaced a small distance from the micropore medium 30, providing an intermediate grid seals the air flow therebetween. This arrangement minimizes contamination and abrasion of the micropore medium 30 by the cellulosic fibrous structure 10.

As illustrated in FIG. 4, the micropore medium 30 may be made of a laminar construction. However, it is understood that a single lamina micropore medium 30 may be feasible, depending upon its strength, the particular combination of pressure differentials and flow resistances described above utilized for the selected papermaking process.

The micropore medium 30, and the entire apparatus 15 used to manufacture the cellulosic fibrous structure 10, may be thought of as having warp and shute directions. As used herein the "warp" direction refers to the direction within the plane of the cellulosic fibrous structure 10 and parallel to its transport throughout the papermaking apparatus 15. As used herein the "shute" direction refers to the direction within the plane of the cellulosic fibrous structure 10 web orthogonal to the warp direction and is generally transverse the direction of transport during manufacture.

The first through fifth laminae 38, 40, 42, 44, and 46 of the micropore medium 30 may be made of any material suitable to withstand the heat, moisture, and pressure indigenous to and incidental to the papermaking process without imparting deleterious effects or properties to the cellulosic fibrous structure 10. It is important that the micropore medium 30 laminate not excessively deflect or deform normal to the plane of the embryonic web 21 during manufacture, otherwise the desirable uniform air flow therethrough, may not be maintained. Any combination of laminae 38, 40, 42, 44, and 46 or other components which provides a flow resistance that is the limiting orifice in the flow path and does not deflect or less than adequately support the cellulosic fibrous structure 10 in operation is suitable for the micropore medium 30. It is only necessary that each lamina 38, 40, 42, 44, or 46 be supported by the subjacent lamina 38, 40, 42, 44, or 46 without excessive deflection.

For the embodiments described herein, a laminate having a first lamina 38 which is closest to, and may even be in contacting relationship with the embryonic web 21, and having a functional pore size of about six to seven microns across may be utilized. Such a first lamina 38 may be formed by a Dutch twill weave of metallic warp and shute fibers. The warp fibers may have a diameter of about 0.038 millimeters (0.0015 inches). The shute fibers may have a diameter of about 0.025 millimeters (0.001 inches). The warp and shute fibers may be woven into a first lamina 38 having a caliper of about 0.071 millimeters (0.0028 inches) and a count of about 128 fibers per centimeter (325 fibers per inch) in the warp direction and about 906 fibers per centimeter (2,300 fibers per inch) in the shute direction. The first lamina 38 may be calendered, as desired, to increase its flow resistance.

For the embodiments described herein, a laminate having a second lamina 40 which is subjacent and in contact with the first lamina 38, and having a square pore size of about 93 microns may be utilized. Such a second lamina 40 may be formed by a plain square weave of metallic warp and shute fibers. The warp fibers may have a diameter of about 0.076 millimeters (0.003 inches). The shute fibers may have a diameter of about 0.076 millimeters (0.003 inches). The warp and shute fibers may be woven into a lamina having a caliper of about 0.152 millimeters (0.006 inches) and a count of about 59 fibers per centimeter (150 fibers per inch) in the warp direction and about 59 fibers per centimeter (150 fibers per inch) in the shute direction.

For the embodiments described herein, a laminate having a third lamina 42 which is subjacent and in contact with the second lamina 40 and having a square pore size of about 234 microns (0.092 inches) and a count of about 24 fibers per centimeter (60 fibers per inch) in the warp direction and about 24 fibers per centimeter (60 fibers per inch) in the shute direction is suitable. Such a third lamina 42 may be formed by a plain square weave of metallic warp and shute fibers. The warp fibers may have a diameter of about 0.191 millimeters (0.075 inches). The shute fibers may have a diameter of about 0.191 millimeters (0.075 inches). The warp and shute fibers may be woven into a lamina having a caliper of about 0.254 millimeters (0.010 inches) and a count of about 24 fibers per centimeter (60 fibers per inch) in the warp direction and about 24 fibers per centimeter (60 fibers per inch) in the shute direction.

For the embodiments described herein, a laminate having a fourth lamina 44 which is subjacent the third lamina 42 and having a functional pore size of about 265 to about 285 microns may be utilized. Such a fourth lamina 44 may be formed by a plain Dutch weave of metallic warp and shute fibers. The warp fibers may have a diameter of about 0.584 millimeters (0.023 inches). The shute fibers may have a diameter of about 0.419 millimeters (0.0165 inches). The warp and shute fibers may be woven into a lamina having a caliper of about 0.813 millimeters (0.032 inches) and a count of about 5 fibers per centimeter (12 fibers per inch) in the warp direction and about 25 fibers per centimeter (64 fibers per inch) in the shute direction.

For the embodiments described herein, the fifth lamina 46 is subjacent the fourth lamina 44 and in contact with the periphery of the porous cylinder 32. The fifth lamina 46 is made of a perforate metal plate. A perforate plate having a thickness of about 1.52 millimeters (0.060 inches) and provided with 2.38 millimeters (0.0938 inches) diameter holes staggered at a 60 degree angle and equally and isometrically spaced about 4.76 millimeters (0.188 inches) from the adjacent holes.

The first through fourth laminae 38, 40, 42, and 44 of a suitable micropore medium 30 may be made of 304L stainless steel. The fifth lamina 46 may be made of 304 stainless steel. A suitable micropore medium 30 may be supplied by the Purolator Products Company of Greensboro, N.C. as Poroplate Part No. 1742180-07. If desired, the first lamina 38 may be ordered directly from Haver & Boecker of Oelde Westfalen, Germany as 325×2300 DTW 8 fabric, calendered as desired, up to about 10 percent.

The micropore medium 30 may be tungsten inert gas full penetration welded from the fifth lamina 46 to the first lamina 38, to form the desired shape and size of the micropore medium 30. A particularly desired shape is a cylindrical shell, for application onto the porous cylinder 32. The micropore medium 30 shaped like a cylindrical shell may be joined to the porous cylinder 32 by a shrink fit. To accomplish the shrink fit, the micropore medium 30 may be heated, without contamination from the heating means, then disposed on the outside of the porous cylinder 32 and allowed to shrink therearound as the micropore medium 30 cools. The shrink fit should be sufficient to prevent angular deflection between the micropore medium 30 and the porous cylinder 32 and sufficient to overcome any asperities in the laminae 38, 40, 42, 44, and 46 of the micropore medium 30, without imparting undue stresses thereto.

Preferably the porous cylinder 32 is provided with a periphery (not shown) adapted to accommodate the cylindrically shaped micropore medium 30. The periphery may also be cylindrically shaped and provided with a plurality of holes therethrough and axially oriented ribs intermediate the holes. The holes and ribs may be circumferentially spaced about 15.75 millimeters (0.620 inches) apart and the holes axially spaced about 60 millimeters (2.362 inches) apart. The ribs may have a radial extent of about 6 millimeters (0.24 inches) and a circumferential width of about 3 millimeters (0.19 inches). The holes may be about 12 millimeters (0.472 inches) in diameter and axially offset about 12.7 millimeters (0.500 inches) from the holes in the next row. This periphery may be about 43 millimeters (1.69 inches) in radial thickness at the base of the ribs. This arrangement provides a periphery having approximately 12% open area and a pattern repeat of approximately 27.1 centimeters (10.67 inches).

Of course, it is not necessary that the exact arrangement, number, or size of laminae 38, 40, 42, 44, and 46 described above be utilized to obtain the benefits of the present invention. Thus, any combination of first lamina 38 and subjacent laminae 38, 40, 42, 44, and 46 having pores or holes which provide the sufficient and proper flow resistance and are small enough to prevent deflection of the superjacent lamina into the pores or holes is adequate.

Internal to the circular segment of the porous cylinder 32 subtended by the cellulosic fibrous structure 10 is a means for causing the air flow through the cellulosic fibrous structure 10. Such air flow causing means typically include blowers, fans, and vacuum pumps, are well known in the art and will not be further discussed herein.

Generally, a plural lamina micropore medium 30 having increasing pore sizes in the direction of downstream air flow promotes lateral flow of the air, in the plane parallel that of the embryonic web 21, through the micropore medium 30. Of course, it is important that the principal air flow occur normal to the plane of the embryonic web 21, so that in addition to evaporative losses, water is removed from the embryonic web 21 while the water is still in the liquid form.

It is particularly desirable that liquid water be removed from the embryonic web 21, so that energy is not wasted overcoming the latent heat of vaporization of the liquid in the evaporative process. Thus by using the apparatus 15 and process described herein, energy is efficiently utilized by dewatering the embryonic web 21 through mechanical entrainment of liquid water and evaporation of water vapor. Of course, all of the aforementioned dewatering occurs without prejudice or preference to the densities or basis weights of the various regions 12 of the cellulosic fibrous structure 10, due to the uniform flow.

By utilizing a micropore medium 30 having the 128 warp count per centimeter by 906 shute count per centimeter disclosed above and a pore size of six microns, it can be assured that such a micropore medium 30 will be the limiting orifice for air flow through an embryonic cellulosic fibrous structure 10 web having a caliper of about 0.15 to about 1.0 millimeters (0.006 to 0.040 inches), and a basis weight of about 0.013 kilograms per square meter to about 0.065 kilograms per square meter (eight to forty pounds per 3,000 square feet). It is to be recognized, however that as the pressure differential across the embryonic web 21 and micropore medium 30 increases or decreases and, the basis weight or density of the embryonic web 21 increases or decreases, the pore sizes of the laminae 38, 40, 42, 44, and 46, particularly of the first lamina 38 in contact with the embryonic web 21, may have to be adjusted accordingly.

Referring again to FIG. 2, after the cellulosic fibrous structure 10 leaves the porous cylinder 32 having the micropore medium 30, the cellulosic fibrous structure 10 is considered to be limiting-orifice-through-air dried. The limiting-orifice-through-air dried web 50 is then transported, on the drying belt 28, from the takeoff roll 36 to another dryer such as a through-air dryer, an infrared dryer, a nonthermal dryer, or a Yankee drying drum 56, or an impingement dryer, such as a hood 58, which dryers may either be used alone or in combination with other drying means.

The manufacturing process described herein is particularly suited for use with a Yankee drying drum 56. When using a Yankee drying drum 56 in this manufacturing process, heat from the Yankee drying drum 56 circumference is conducted to the limiting-orifice-through-air dried web 50 which is in contact with the Yankee drying drum 56 circumference. The limiting-orifice-through-air dried web 50 may be transferred from the drying belt 28 to the Yankee drying drum 56 by means of a pressure roll 52, or by any other means well known in the art. After transfer of the limiting-orifice-through-air dried web 50 to the Yankee drying drum 56, the limiting orifice through air web 50 is dried on the Yankee drying drum 56 to a consistency of at least about 95 percent.

The limiting-orifice-through-air dried web 50 may be temporarily adhered to the Yankee drying drum 56 through use of creping adhesive. Typical creping adhesive includes polyvinyl alcohol based glues, such as disclosed in U.S. Pat. No. 3,926,716 issued Dec. 16, 1975 to Bates, which patent is incorporated herein by reference for the purpose of showing an adhesive suitable for adhering a limiting-orifice-through-air dried web 50 to a Yankee drying drum 56 by application of such adhesive to either.

Optionally, the dry web may be foreshortened, so that its length in the warp direction is reduced and the cellulosic fibers are rearranged with disruption of the fiber to fiber bonds. Foreshortening can be accomplished in several ways, the most common, well known in the art and preferred being creping. In a creping operation, the limiting-orifice-through-air dried web 50 is adhered to a rigid surface, such as that of the Yankee drying drum 56, then removed from that surface with a doctor blade 60. After creping and removal from the Yankee drying drum 56, the cellulosic fibrous structure 10 may be calendered or otherwise converted as desired.

Referring to FIG. 3B, if desired, the porous cylinder 32 may be provided with a positive internal pressure, i.e., so that the internal pressure of the porous cylinder 32 is greater than the atmospheric pressure. In this arrangement the air flow occurs in the direction from the inside of the porous cylinder 32 through to the outside of the porous cylinder 32.

Such an arrangement requires that the drying belt 28 still be disposed radially outwardly of the embryonic web 21 and that the micropore medium 30 still be radially inward of and in contact with the embryonic web 21. In the arrangement illustrated in FIG. 3B and having a positive internal pressure, the air flow is from the coarsest and fifth lamina 46 of the micropore medium 30 to and through the first lamina 38. The air flow then passes out of the first lamina 38 to and through the embryonic web 21. After passing through the embryonic web 21, the air flow then continues the flow path through the drying belt 28.

Both the subatmospheric pressure and positive pressure porous rolls illustrated in FIGS. 3A and 3B have certain advantages. For example, the subatmospheric porous cylinder 32 illustrated in FIG. 3A provides the advantage that the embryonic web 21 stays in intimate contact with the micropore medium 30, promoting uniform distribution of the air flow. Also, the subatmospheric porous cylinder 32 is judged to more efficiently dewater the embryonic web 21 than the positive pressure porous cylinder 32. Conversely, the positive pressure porous cylinder 32 illustrated in FIG. 3B provides the advantages that contaminates entrained in the air, water, or the cellulosic fibrous structure 10 have a lesser propensity to dry on and subsequently come to reside on or in the first lamina 38, which has the finest pores, of the micropore medium 30.

It is prophetically possible the micropore medium 30 could be disposed on the surface of a porous cylinder 32, and the limiting-orifice-through-air dried web 50 held in place without a separate drying belt 28. This arrangement would, of course, require the embryonic web 21 to be dried to a consistency sufficient that it remains intact while it is on the micropore medium 30 and is preferably used in conjunction with a subatmospheric pressure porous cylinder 32. This arrangement may be particularly advantageous when the limiting-orifice-through-air dried web 50 is essentially dry after leaving the micropore medium 30 or when relatively higher temperature air flow is desired.

The porous cylinder 32 may have different zones, each with a different pressure. This arrangement allows a less expensive means for creating the subatmospheric or positive pressure and for causing the air flow to or through the embryonic web 21 to be utilized. For example, a first zone of the subatmospheric pressure porous cylinder 32 may be provided with a relatively small differential pressure, and particularly a differential pressure which is less than the breakthrough pressure of the menisci of the limiting orifices in the micropore medium 30; a second zone with a much greater differential pressure; and a third zone with a differential pressure less than or equal to that of the first zone, but which allows for air flow therethrough due to the second zone having exceeded the breakthrough pressure. For example, the first zone may provide a differential pressure of about 10.2 to 17.8 centimeters of Mercury (4 to 7 inches of Mercury). The second zone may provide a pressure differential of about 22.9 centimeters of Mercury (9 inches of Mercury) to substantially empty the orifices of the water. The third zone may be held at or slightly below the breakthrough differential pressure of the particular system to conserve energy, but still provide good air flow.

The zones need not provide equal residence times of the embryonic web 21 on the micropore medium 30. Particularly, to further conserve energy, the second zone having the greater pressure differential may be circumferentially smaller than the first and third zones.

If it is desired to have only one zone of a particular pressure for a given porous 10 cylinder 32, two or more porous cylinders 32 may be utilized in series, each having a different positive or subatmospheric internal pressure. Also, it is possible to cascade two or more porous cylinders 32, one having a subatmospheric internal pressure and one having a positive internal pressure.

In yet another variation (not shown), it is prophetically possible the micropore medium 30 is embodied in the form of an endless belt. Such an endless belt would parallel the drying belt 28 for a distance sufficient to obtain the desired residence time, discussed above. The embryonic web 21 would still be intermediate the micropore medium 30 belt and the drying belt 28. As discussed above relative to FIG. 3A and 3B, such a micropore medium 30 belt may be made of a single lamina of polyester or nylon fiber having a mesh size and count sufficient, as desired above, to be the limiting orifice in the air flow through the embryonic web 21.

The embodiment of the micropore medium 30 wrapped around a porous cylinder 32 illustrated in FIGS. 2–3B above prophetically enjoys certain advantages over a micropore medium 30 embodied in a belt. For example, a porous cylinder 32 type micropore medium 30 would be expected to have greater integrity and longer life, but imparts more differences to the cellulosic fibrous structure 10 at the weld seams.

Conversely, the endless belt embodiment of the micropore medium is preferentially easier to clean, as backflushing may be accomplished by normal shower techniques. Furthermore, a single lamina polyester belt has the advantage that more of the backflush is actually expelled through the pores in the micropore medium 30 in a uniform manner. Such an embodiment can be more easily restored to operability in the event of failure of the micropore medium than a porous cylinder incorporating the micropore medium and have narrower seams. In a multi-lamina micropore medium 30, such as illustrated in FIG. 4, much of the backflush water is channeled in lateral flow between or through adjacent laminae 38, 40, 42, 44, and 46 and due, in part, to the hole pattern in the periphery of the porous cylinder 32, is not uniformly expelled through the finest pores of the first lamina 38 where it is most needed.

Instead of the woven laminae 38, 40, 42, 44, and 46 embodiment of the micropore medium 30 discussed above, it is possible that the micropore medium 30 may be chemically etched, may be made of sintered hot, isostatically pressed sintered metal, or may be made in accordance with the teachings of the aforementioned commonly assigned U.S. Pat. No. 4,556,450 issued Dec. 3, 1985 to Chuang et al.

In each embodiment of the micropore medium 30, it is preferable to have the first lamina 38, i.e. that which provides the greatest flow resistance and typically would have the finest pores therethrough, on one surface of the micropore medium 30, and particularly on the surface of the micropore medium 30 which is in contacting relationship with the cellulosic fibrous structure 10. This arrangement reduces lateral air flow through the micropore medium 30 and preferably minimizes any non-uniform air distributions associated with such lateral air flow.

It will be apparent that there are many other embodiments and variations of this invention, all of which are within the scope of the appended claims.

What is claimed is:

1. A micropore medium for use with a limiting-orifice-through-air-drying papermaking apparatus in combination with an embryonic web of cellulosic fibers having moisture distributed therein, said micropore medium comprising a limiting orifice for air flow through said embryonic web, so that said moisture distribution is equally or more uniform after air flow therethrough. wherein said limiting orifice comprises a laminate of plural laminae, each lamina of said laminae having pores therethrough for said air flow.

2. A medium according to claim 2 wherein the lamina having the greatest flow resistance is on one surface of the micropore medium, which surface is in contacting relationship with the embryonic web.

3. An apparatus for limited-orifice-through-air drying an embryonic web of cellulosic fibers having moisture distributed therein, said apparatus comprising:

a means to cause airflow through the embryonic web;

a through-air drying belt for supporting the embryonic web and in contacting relationship with one face thereof; and a micropore medium disposed on the opposite side of the embryonic web, wherein said micropore medium is the limiting orifice for airflow through said embryonic web, so that said moisture distribution is equally or more uniform after air flow therethrough.

4. An apparatus according to claim 3 further comprising a porous cylinder, wherein said micropore medium is peripherally disposed on said cylinder.

5. An apparatus according to claim 4 wherein said cylinder has a subatmospheric internal pressure.

6. An apparatus according to claim 4 wherein said cylinder has a positive internal pressure.

7. An apparatus according to claim 3 wherein said micropore medium is disposed in the form of an endless belt.

8. A process for limiting-orifice-through-air-drying a cellulosic fibrous structure, said process comprising the steps of:

providing a cellulosic embryonic web to be dried and having a moisture distribution therein;

providing a means for causing air flow through said embryonic web;

providing a drying belt to support said embryonic web;

providing a micropore medium on the side of said embryonic web opposite said drying belt, so that said embryonic web is intermediate said drying belt and said micropore medium, and wherein said micropore medium is the limiting orifice for said air flow;

disposing said embryonic web on said drying belt; and causing air flow through said embryonic web and said micropore medium, so that said moisture distribution is equally or more uniform after air flow through said embryonic web.

9. A process according to claim 8 wherein said air flow through said embryonic web is in the direction from said drying belt to said micropore medium.

10. A process according to claim 8 wherein said air flow through said embryonic web is in the direction from said micropore medium to said drying belt.

11. A cellulosic fibrous structure produced by the process of claim 8.

12. A cellulosic fibrous structure produced by the process of claim 9.

13. A cellulosic fibrous structure produced by the process of claim 10.

* * * * *

UNITED STATES PATENT AND TRADEMARK OFFICE

CERTIFICATE OF CORRECTION

PATENT NO. : 5,274,930

DATED : JANUARY 4, 1994

INVENTOR(S) : DONALD E. ENSIGN, WILBUR R. KNIGHT, PAUL D. TROKHAN

It is certified that error appears in the above-identified patent and that said Letters Patent is hereby corrected as shown below:

| | |
|---|---|
| Column 4, line 46 | delete "previous" and insert therefor --pervious--. |
| Column 15, line 37 | delete "through." (the period) and insert therefor --through,-- (the comma). |

Signed and Sealed this

Eighth Day of November, 1994

Bruce Lehman

*Attest:*

BRUCE LEHMAN

*Attesting Officer*

*Commissioner of Patents and Trademarks*